US011085618B2

(12) United States Patent
Aoki

(10) Patent No.: US 11,085,618 B2
(45) Date of Patent: Aug. 10, 2021

(54) VEHICLE LAMP HAVING A HEATSINK

(71) Applicant: Koito Manufacturing Co., Ltd., Tokyo (JP)

(72) Inventor: Yusuke Aoki, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 8 days.

(21) Appl. No.: 16/278,986

(22) Filed: Feb. 19, 2019

(65) Prior Publication Data

US 2019/0271457 A1 Sep. 5, 2019

(30) Foreign Application Priority Data

Mar. 2, 2018 (JP) ..... JP2018-037833

(51) Int. Cl.

| | |
|---|---|
| ***F21V 23/00*** | (2015.01) |
| ***F21S 45/47*** | (2018.01) |
| *F21V 7/06* | (2006.01) |
| *F21S 41/141* | (2018.01) |
| *F21S 41/20* | (2018.01) |
| *F21Y 115/10* | (2016.01) |

(52) U.S. Cl.

CPC ..... *F21V 23/001* (2013.01); *F21S 45/47* (2018.01); *F21S 41/141* (2018.01); *F21S 41/285* (2018.01); *F21V 7/06* (2013.01); *F21Y 2115/10* (2016.08)

(58) Field of Classification Search

CPC ..... F21S 41/141; F21S 41/36; F21S 41/25; F21S 41/39; F21S 43/14; F21S 45/49; F21S 43/31; F21S 43/37; F21Y 2115/10; F21V 29/89; F21V 29/503; F21V 23/001; F21V 23/06

See application file for complete search history.

(56) References Cited

U.S. PATENT DOCUMENTS

| | | | | |
|---|---|---|---|---|
| 7,878,695 | B2 * | 2/2011 | Ishida | F21S 41/143 362/539 |
| 8,277,100 | B2 * | 10/2012 | Tokunaga | F21S 41/147 362/547 |
| 10,253,943 | B2 * | 4/2019 | Kim | F21S 41/151 |

(Continued)

FOREIGN PATENT DOCUMENTS

| | | | | |
|---|---|---|---|---|
| JP | 2011134677 A | * | 7/2011 | F21V 19/001 |
| JP | 2013175343 A | * | 9/2013 | |
| JP | 2015-207391 A | | 11/2015 | |

OTHER PUBLICATIONS

JP2011-134677, Jul. 2011, machine translation (Year: 2011).*
JP2013-175343, Sep. 2013, machine translation (Year: 2013).*

*Primary Examiner* — Tracie Y Green
(74) *Attorney, Agent, or Firm* — Abelman, Frayne & Schwab

(57) ABSTRACT

A vehicle lamp includes a light source; a power supply configured to supply power to the light source; a heat sink configured to dissipate heat from the light source; and a light controller configured to control light from the light source. The heat sink has a configuration in which a plate is bent so as to have a first portion and a second portion that is bent at a predetermined angle with respect to the first portion, the light source is arranged on the first portion, and the second portion includes an insertion portion through which the power supply connected to the light source is inserted.

8 Claims, 4 Drawing Sheets

(56) References Cited

U.S. PATENT DOCUMENTS

| | | | | |
|---|---|---|---|---|
| 2016/0091164 | A1* | 3/2016 | Mornet | H05K 3/32 362/547 |
| 2016/0201869 | A1* | 7/2016 | Shibata | B60Q 1/076 362/512 |
| 2017/0009954 | A1* | 1/2017 | Ueno | F21S 41/192 |
| 2019/0041024 | A1* | 2/2019 | Yamaguchi | F21S 41/147 |
| 2019/0271596 | A1* | 9/2019 | Aoki | F21S 43/37 |

* cited by examiner

VEHICLE LAMP HAVING A HEATSINK

CROSS-REFERENCE TO RELATED APPLICATIONS

This application is based on and claims priority from Japanese Patent Application No. 2018-037833, filed on Mar. 2, 2018, with the Japan Patent Office, the disclosure of which is incorporated herein in its entirety by reference.

TECHNICAL FIELD

The present disclosure relates to a vehicle lamp. Particularly, the present disclosure relates to a vehicle lamp using a light source such as an LED, and a parabolic reflector.

BACKGROUND

A vehicle lamp including a substrate in which an LED is mounted on a lower surface of a metallic plate-like support member, a parabolic reflector that reflects light from the LED to the front of the lamp, and a heat dissipation fin provided to be erected on an upper surface of the support member and configured to dissipate heat from the LED, is disclosed in Japanese Patent Laid-Open Publication No. 2015-207391.

SUMMARY

The vehicle lamp disclosed in Japanese Patent Laid-Open Publication No. 2015-207391 has a problem that, as the dissipation fins are provided on the upper surface of the support member, a lamp chamber is enlarged in a height direction in addition to the fact that the structure thereof becomes complicated.

The present disclosure has been made in consideration of the circumstances, and the present disclosure is to provide a vehicle lamp able to be simplified and miniaturized.

In order to solve the problem, a vehicle lamp according to an aspect of the present disclosure includes a light source, a power supply configured to supply power to the light source, a heat sink configured to dissipate heat from the light source, and a light controller configured to control light from the light source. The heat sink has a configuration in which a plate is bent so as to have a first portion and a second portion that is bent at a predetermined angle with respect to the first portion, the light source is arranged on the first portion, and the second portion includes an insertion portion through which the power supply member connected to the light source is inserted.

The power supply may have a connector structure including a standby side connector and a movable side connector. The standby side connector may be fixed to the first portion, and the movable side connector may be configured to be insertable into/removable from the standby side connector via the insertion portion of the second portion.

An area of the insertion portion is larger than a cross-sectional area of the movable side connector perpendicular to an insertion direction.

The power supply may include a cable. The vehicle lamp may further include a cable clamp that routes the cable on the second portion. The cable clamp may be arranged at a peripheral portion of the second portion.

According to the present disclosure, it is possible to provide a vehicle lamp able to be simplified and miniaturized.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, a vehicle lamp according to an embodiment of the present disclosure will be described in detail with reference to the drawings. In the present specification, the terms representing directions such as, for example, "upper," "lower," "front," "rear," "left," "right," "inner," and "outer" as used here mean directions in a posture when the vehicle lamp is mounted on the vehicle.

Figure 1:
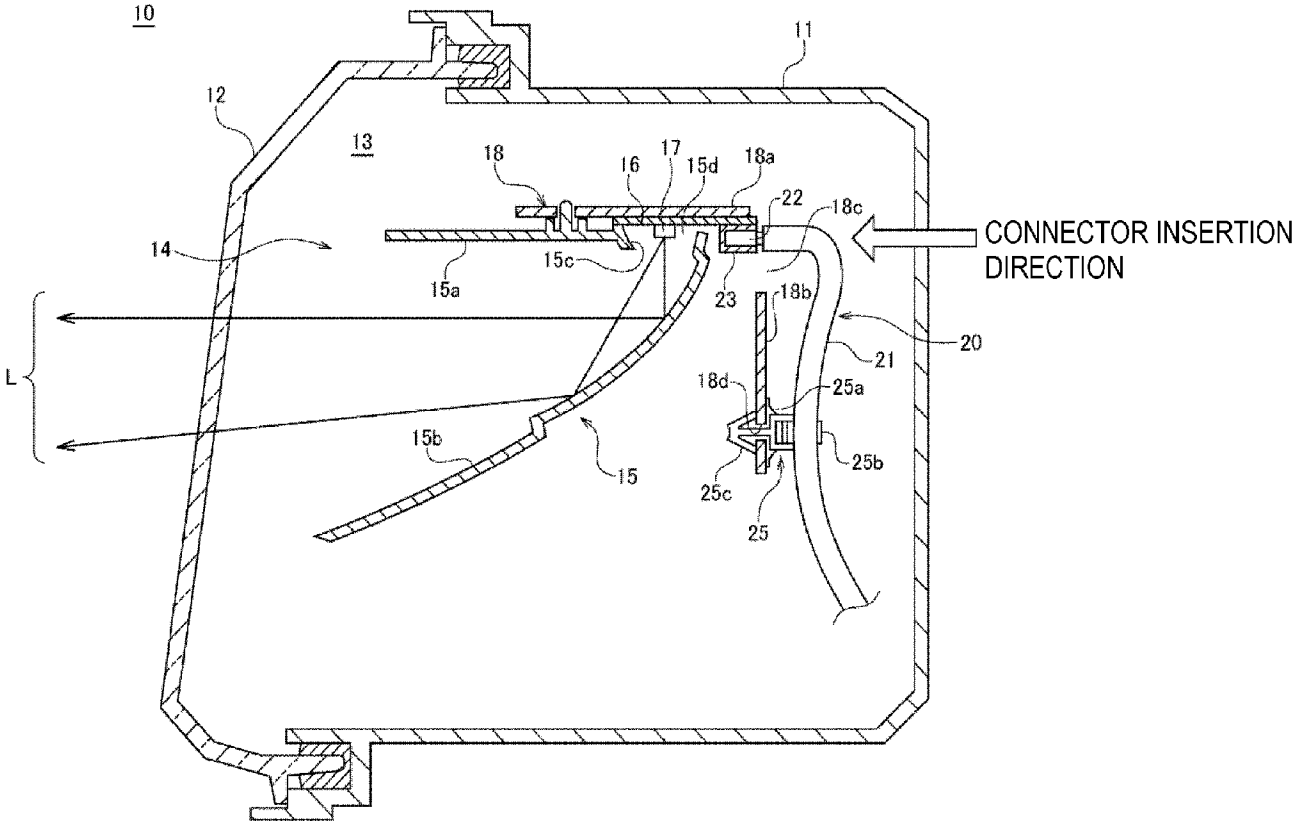
FIG. 1 is a schematic cross-sectional view of a vehicle lamp according to an embodiment of the present disclosure.

FIG. 1 is a schematic cross-sectional view of a vehicle lamp 10 according to an embodiment of the present disclosure. The vehicle lamp 10 may be a headlight arranged at the front portion of a vehicle.

As illustrated in FIG. 1, the vehicle lamp 10 includes a lamp body 11 and a transparent outer cover 12 that covers a front surface opening of the lamp body 11. The lamp body 11 and the outer cover 12 form a lamp chamber 13.

A lamp unit 14 is accommodated in the lamp chamber 13. The lamp unit 14 may be configured to irradiate a high beam light distribution pattern or a low beam light distribution pattern. The lamp unit 14 may be tiltably supported with respect to the lamp body 11 by a support member (not illustrated) for the purpose of aiming adjustment.

The lamp unit 14 includes a reflector unit 15, a substrate 16, an LED 17 as a light source, and a heat sink 18.

The reflector unit 15 includes a horizontal extending portion 15*a* that extends in a horizontal direction, a reflector portion 15*b* as a light control member that controls light from the LED 17, and a shade portion 15*c*.

A hole portion 15*d* configured to guide the light from the LED 17 to the reflector portion 15*b* is formed in the horizontal extending portion 15*a*. The reflector portion 15*b* extends forward and obliquely downward from a rear portion of the hole portion 15*d* in the horizontal extending portion 15*a*. The reflector portion 15*b* is a parabolic reflector that reflects the light from the LED 17 to the front of the lamp. The reflector portion 15*b* has a reflecting surface formed with reference to a parabolic surface of rotation. A rotation center axis of the parabolic surface of the rotation of the reflecting surface is an optical axis of the reflector portion 15*b*. The reflector portion 15*b* is arranged such that the optical axis thereof faces the front-and-rear direction (horizontal direction) of the vehicle. The LED 17 is arranged at a focal position of the reflecting surface of the reflector portion 15*b*.

The shade portion 15*c* is formed at a front portion of the hole portion 15*d* in the horizontal extending portion 15*a*. The shade portion 15*c* prevents the light from the LED 17 from being emitted directly to the outside of the lamp.

The substrate 16 is supported on the horizontal extending portion 15*a* of the reflector unit 15. The LED 17 is mounted on the substrate 16 such that the light emitting surface faces downward. As described above, the LED 17 is arranged at the focal position of the reflecting surface of the reflector portion 15*b*. The LED 17 emits light by being supplied with a current from the substrate 16. FIG. 1 illustrates an example of light rays that are emitted from the LED 17 and then reflected at the reflecting surface of the reflector portion 15*b* to be emitted forward of the lamp.

The current for causing the LED 17 to emit light is supplied to the substrate 16 by a power supply member 20. The power supply member 20 includes a cable 21 connected to a current source (not illustrated) outside the lamp chamber, a movable side connector 22 provided at a distal end portion of the cable 21, and a standby side connector 23 provided at a rear end portion of the lower surface of the substrate 16. The standby side connector 23 is positioned behind the reflector portion 15*b*. The movable side connector 22 may be inserted into or removed from the standby side connector 23.

Figure 2:
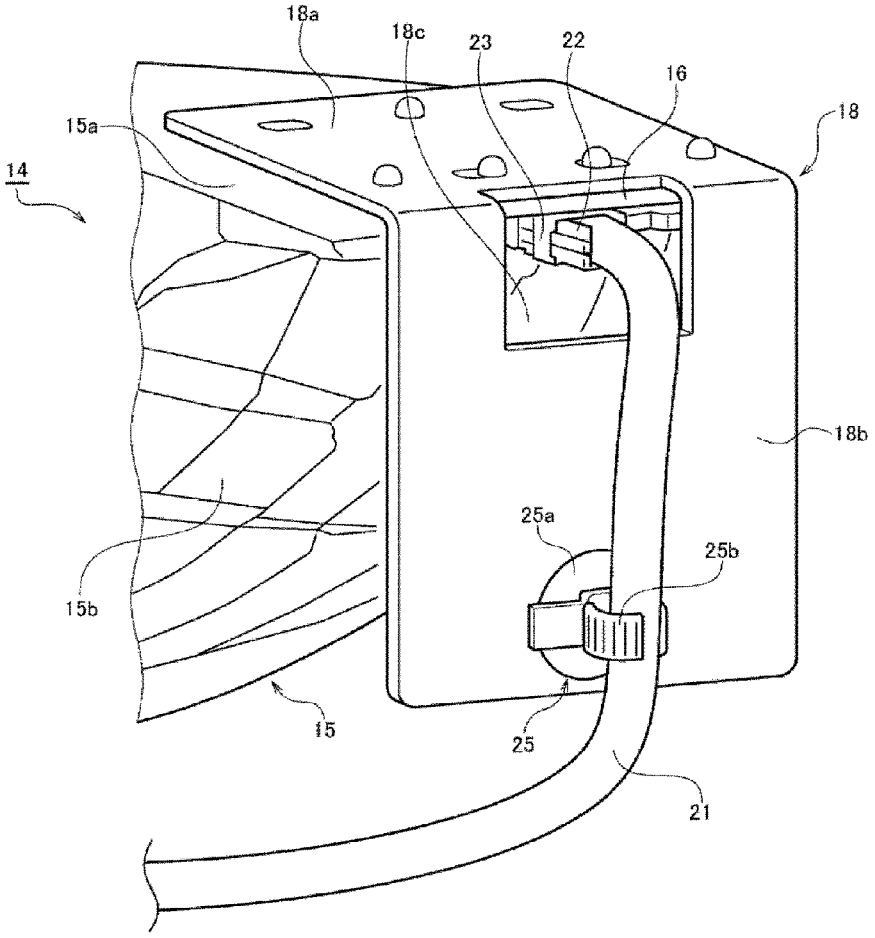
FIG. 2 is a perspective view illustrating a state where a movable side connector is inserted.
Figure 3:
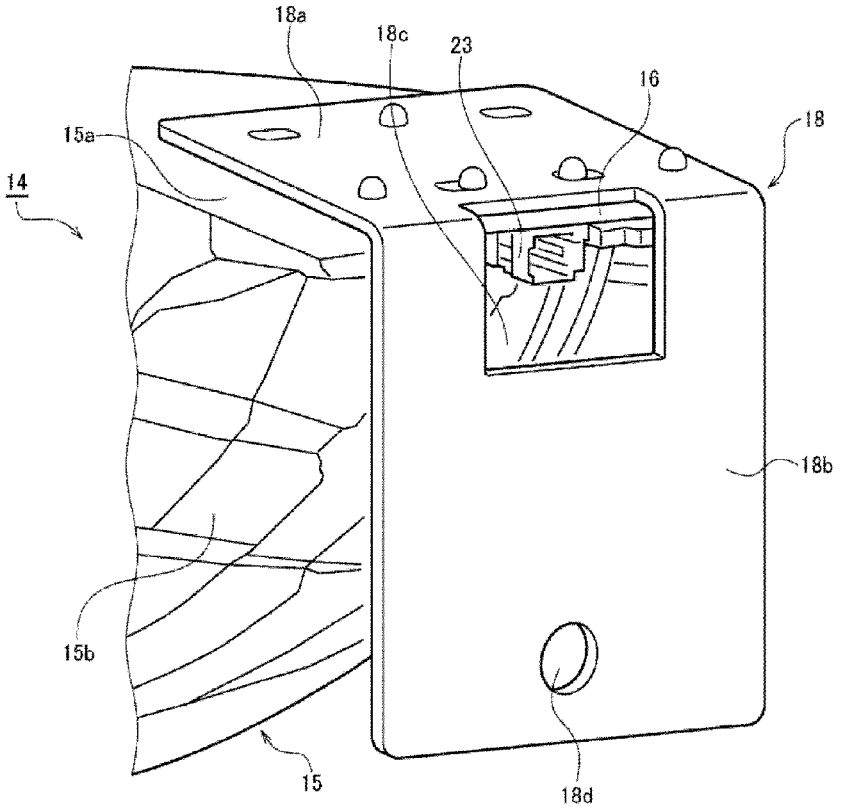
FIG. 3 is a perspective view illustrating a state where a movable side connector is removed.

FIG. 2 is a perspective view illustrating a state where the movable side connector 22 is inserted into the standby side connector 23. FIG. 3 is a perspective view illustrating a state where the movable side connector 22 is removed from the standby side connector 23.

The heat sink 18 has a configuration in which a metallic plate such as an aluminum plate is bent in an L-shape, and has a first portion 18*a* extending in the horizontal direction and a second portion 18*b* bent at a predetermined angle (in the present embodiment, 90°) with respect to the first portion 18*a*. The heat sink 18 is arranged such that the first portion 18*a* is supported on the upper surface of the substrate 16, and also the second portion 18*b* extends downward from the first portion 18*a* behind the reflector portion 15*b*. An insulating sheet may be interposed between the first portion 18*a* of the heat sink 18 and the upper surface of the substrate 16.

As illustrated in FIG. 1, the substrate 16 is arranged on the lower surface of the first portion 18*a* of the heat sink 18, and the LED 17 is arranged on the lower surface of the substrate 16. Therefore, heat generated from the LED 17 is transferred to the first portion 18*a* and the second portion 18*b* of the heat sink via the substrate 16, and then dissipated into the air in the lamp chamber 13.

In the vehicle lamp 10 according to the present embodiment, an insertion portion 18*c* through which the power supply member 20 is inserted is formed at the second portion 18*b* of the heat sink 18. The insertion portion 18*c* is an opening formed at an upper end portion of the second portion 18*b*, and as illustrated in FIG. 3, the standby side connector 23 fixed to the first portion 18*a* is exposed at the rear side of the lamp unit 14 through the insertion portion 18*c*. In the present embodiment, the movable side connector 22 may be inserted into/removed from the standby side connector 23 through the insertion portion 18*c* provided at the second portion 18*b* of the heat sink 18. An area of the insertion portion 18*c* may be larger than a cross-sectional area of the movable side connector 22 perpendicular to the insertion direction. In a more appropriate embodiment, the area of the insertion portion 18*c* may be formed to have a size enough to accommodate a finger of an operator or a jig inserting and removing the movable side connector 22.

Further, in the vehicle lamp 10 according to the present embodiment, a cable clamp 25 that routes the cable 21 on the second portion 18*b* is provided at the second portion 18*b* of the heat sink 18.

The cable clamp 25 is made of, for example, an elastic member such as resin or rubber, and includes a disc-shaped base portion 25*a*, a holding portion 25*b* provided on the base portion 25*a* to hold the cable 21, and an insertion piece portion 25*c* provided on the opposite side to the holding portion 25*b* of the base portion 25*a* to fix the cable clamp 25 to the second portion 18*b*.

A clamp fixing hold 18*d* through which the insertion piece portion 25*c* of the cable clamp 25 is inserted is formed at the second portion 18*b* of the heat sink 18 (see, e.g., FIG. 3). The insertion piece portion 25*c* is reduced in diameter thereof when it is inserted into the clamp fixing hole 18*d*, and extends in diameter and is locked after it is inserted into the clamp fixing hole 18*d*. Therefore, the cable clamp 25 is fixed to the second portion 18*b* of the heat sink 18. The fixing method of the cable clamp 25 to the second portion 18*b* is not particularly limited. The cable clamp 25 may be fixed by using a screw or a double-sided tape.

It is possible to prevent occurrence of problems such as disconnection in the cable 21 caused by interference with the edge of the metallic second portion 18*b* when the cable 21 is bent, by providing the cable clamp 25 at the second portion 18*b* of the heat sink 18 and clamping the cable 21. The cable clamp 25 may be arranged at a peripheral portion of the second portion 18*b*. In this case, it is possible to prevent the interference between the cable 21 and the edge of the second portion 18*b* more appropriate.

Figure 4:
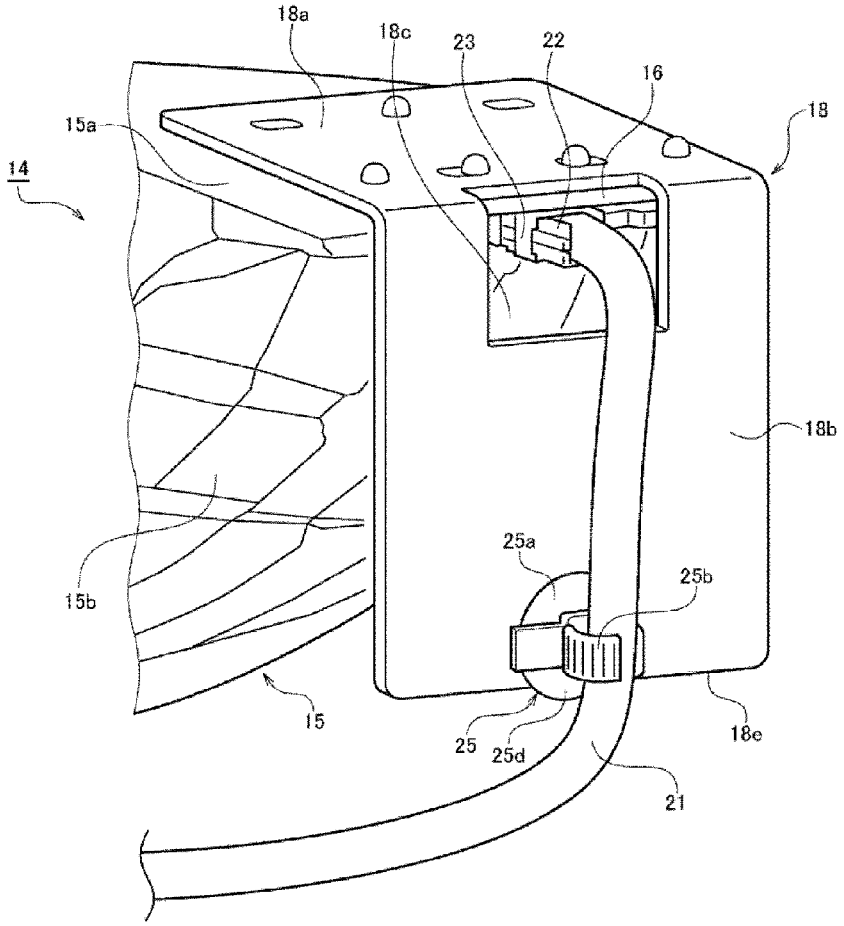
FIG. 4 is a view illustrating a modified example of an attaching method of a cable clamp.

FIG. 4 is a view illustrating a modified example of an attaching method of the cable clamp 25. In the modified example, the cable clamp 25 is attached to the second portion 18*b* such that a portion of the base portion 25*a* protrudes outward beyond an edge 18*e* of the lower end portion of the second portion 18*b* of the heat sink 18. In this case, it is possible to further prevent occurrence of problems such as disconnection in the cable 21 since the interference between the cable 21 and the edge 18*e* of the second portion 18*b* is prevented by the protruded portion 25*d* of the base portion 25*a*.

The vehicle lamp 10 according to the embodiment of the present disclosure has been described. In the vehicle lamp 10, the configuration may be simplified by adopting the heat sink 18 in which the metal plate is bent into an L-shape. Further, since the second portion 18*b* of the heat sink 18 is arranged to extend downward from the first portion 18*a* behind the reflector portion 15*b*, the vehicle lamp may be miniaturized, for example, as compared with a case where the second portion 18*b* extends upward from the first portion 18*a*.

In a case where the second portion 18*b* of the L-shape heat sink 18 is arranged to extend downward from the first portion 18*a* in this manner, the standby side connector 23 is covered and blocked by the second portion 18*b*. Thus, the insertion and removal of the movable side connector 22 may be difficult. Therefore, in the vehicle lamp 10 according to the present embodiment, the insertion portion 18*c* is formed at the second portion 18*b*. Therefore, simplification and miniaturization may be achieved without sacrificing the insertability and movability of the movable side connector 22.

In the above-described embodiment, the opening is provided at the second portion 18*b* of the heat sink 18 as the insertion portion 18*c*. However, the insertion portion 18*c* is not limited to the opening, and may be a cutout portion formed by cutting out a part of the second portion 18*b*.

Further, in the above-described embodiment, the cable 21 having the connector structure is used as the power supply member 20. However, the cable 21 may be connected to the substrate 16 in other methods such as soldering. In this case, the cable 21 may be smoothly arranged by inserting the cable 21 through the insertion portion 18*c* of the heat sink 18.

Further, in the above-described embodiment, the bent angle of the L-shape heat sink 18 is 90°, but other bent angles such as 80° or 70° may be used.

Further, in the above-described embodiment, the shape of the heat sink 18 is the L-shape having one bent portion including the first portion 18*a* and the second portion 18*b*, but the shape of the heat sink 18 is not limited thereto. For example, the shape of the heat sink 18 may be a U-shape having two bent portions including a third portion that extends horizontally forward from the lower end portion of the second portion 18*b*, in addition to the first portion 18*a* and the second portion 18*b*.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a light source;

a power supply including a cable and configured to supply power to the light source;

a heat sink configured to dissipate heat from the light source and having a configuration in which a plate is bent so as to have a first portion on which the light source is arranged and a second portion that is bent at a predetermined angle with respect to the first portion;

a cable clamp including a disc-shaped base and a holder mounted on the disc-shaped base, the disc-shaped base and the holder being positioned at a lowermost edge of the second portion such that the cable clamp routes the cable along the second portion; and a light controller configured to control light from the light source, wherein the second portion includes an insertion portion configured such that the power supply connected to the light source is inserted, and the insertion portion is an opening formed in an upper end portion of the second portion of the plate that meets the first portion.

2. The vehicle lamp of claim 1, wherein the power supply has a connector structure including a standby side connector and a movable side connector, the standby side connector is fixed to the first portion, and the movable side connector is configured to be insertable into/removable from the standby side connector via the insertion portion of the second portion.

3. The vehicle lamp of claim 2, wherein an area of the insertion portion is larger than a cross-sectional area of the movable side connector perpendicular to an insertion direction.

4. The vehicle lamp of claim 2, wherein the standby side connector fixed to the first portion is exposed at a rear side of the vehicle lamp through the insertion portion.

5. The vehicle lamp of claim 2, wherein the standby side connector is positioned behind the light controller.

6. The vehicle lamp of claim 1, wherein the second portion extends downward from the first portion behind the light controller.

7. The vehicle lamp of claim 1, wherein the cable clamp further includes:

an insertion piece portion provided on an opposite side to the holder of the disc-shaped base to fix the cable clamp to the second portion, and the cable clamp is attached to the second portion such that a portion of the disc-shaped base protrudes outward beyond the lowermost edge of the second portion.

8. The vehicle lamp of claim 1, further comprising:

a horizontal extending portion that is provided under the first portion of the heat sink and extends in a horizontal direction, the horizontal extending portion including a hole portion configured to guide the light from the light source to the light controller; and a shade portion that is formed at a front portion of the hole portion in the horizontal extending portion, thereby preventing the light from the light source from being emitted directly to the outside of the vehicle lamp.

* * * * *